United States Patent [19]

Ballestrazzi et al.

[11] 4,381,637

[45] May 3, 1983

[54] DEVICE FOR CORRECTLY POSITIONING THE FILM RELATIVE TO THE ARTICLES TO BE WRAPPED IN A PACKAGING MACHINE

[75] Inventors: Aris Ballestrazzi; Lamberto Tassi, both of Vignola, Italy

[73] Assignee: SITMA - Societa Italiana Macchine Automatiche S.p.A., Spilamberto, Italy

[21] Appl. No.: 140,597

[22] Filed: Apr. 15, 1980

[30] Foreign Application Priority Data

Apr. 24, 1979 [IT] Italy ..... 22145 A/79

[51] Int. Cl.[3] ..... B65B 57/04; B65B 57/12

[52] U.S. Cl. ..... 53/51; 53/64; 53/131; 53/550; 493/35

[58] Field of Search ..... 53/51, 131, 550, 64; 493/6, 11, 35

[56] References Cited

U.S. PATENT DOCUMENTS 2,296,142 9/1942 Campbell ..... 53/51
2,977,730 4/1961 Ardner ..... 53/51
3,411,767 11/1968 Moser et al. ..... 53/51
3,589,095 6/1971 James ..... 53/51
3,789,574 2/1974 Weikert ..... 53/51

*Primary Examiner*—John Sipos
*Attorney, Agent, or Firm*—Cushman, Darby & Cushman

[57] ABSTRACT

In a machine for wrapping individual articles with a thermoplastic film, a device is provided for correctly positioning the film, which is for example printed with certain symbols, relative to the articles. Said device comprises a mechanism for detecting at every instant the position of an article, a photoelectric cell for detecting the position of the film and a comparison circuit which receives signals from both the detecting means. The comparison circuit comprises logical gates (of AND type) and storage means and is associated to timing means for actuating a motor so as to increase or reduce the speed of the film consistently with the positive or negative results of the speed comparison made by the comparison circuit, or to leave said speed unaltered when the phase relationship between the film and the articles has been found correct.

3 Claims, 3 Drawing Figures

DEVICE FOR CORRECTLY POSITIONING THE FILM RELATIVE TO THE ARTICLES TO BE WRAPPED IN A PACKAGING MACHINE

This invention relates to a device for correctly positioning a film web film relative to articles to be packaged in a packaging machine which employs a printed film web as the article-wrapping means.

Packaging machines are known which use a film of a plastics material for wrapping thereby articles in individual packets, which are sometimes caused closely to wrap the articles by heat welding.

Until the film is totally devoid of any scripts or symbols, there is no problem in such machines which is bound to the mutual positioning of the articles and the film. The situation changes, instead, when the film is printed with symbols and/or scripts which must take, of necessity, an accurately defined position relative to the packaged articles. Even a slight mutual shift, as due for example to a different expansion of the film as the speed is varied, to frictional forces or mechanical sliding, may become deleterious, in fact, to the end of an attractive presentation of such articles.

An object of the present invention is thus to provide a device which permits that the position of a printed film relative to the articles to be wrapped may be checked and possibly corrected prior to the article-wrapping operation.

According to the invention, this object is achieved by a device which is characterized in that it comprises first means for detecting the position of the articles prior to their engagement by the printed film, second means for detecting the position of the printed symbols reported on sequential film sections prior to the engagement of said section with the respective articles to be wrapped, means for comparison of the indication of said first and said second detecting means, and actuating means controlled by said comparison means to vary the feeding speed of the film relative to the speed at which said articles are forwarded, and vice versa, in the case in which the indications of said first detecting means do not coincide with those of said second detecting means.

Stated otherwise, the device according to the invention is based on the principle of checking the relative phase between the articles and the symbols printed upon the film and of varying the feeding speed of the articles, or of the film, in the case in which the phasing which has been detected does not correspond to the one which is expected. It becomes thus possible to ensure an accurate positioning of the articles relative to the printed film.

Figure 1:
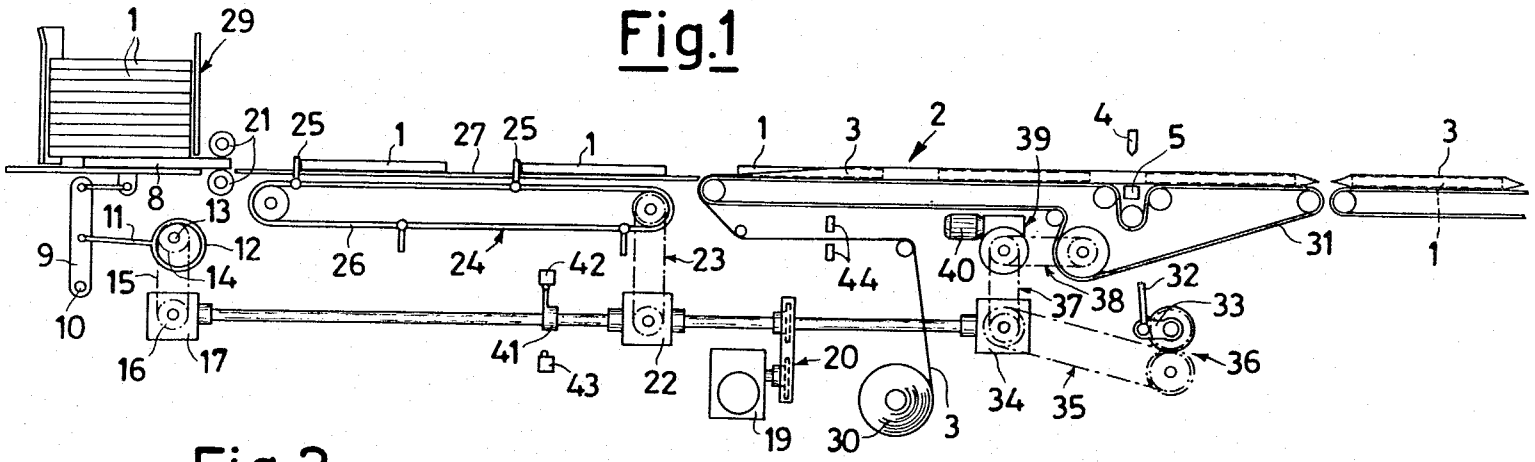

To make the invention more clearly understood, a possible practical embodiment and application of the device of this invention is shown by way of example only in the accompanying drawings, wherein:

FIG. 1 shows a diagrammatical elevational view of a packaging machine which comprises a positioning-control device according to the invention.

Figure 2:
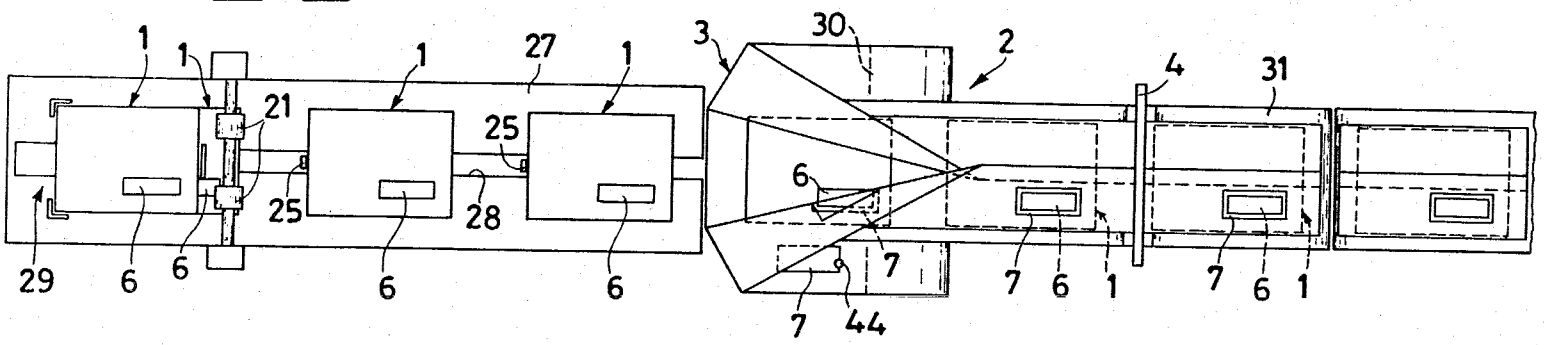
Figure 3:
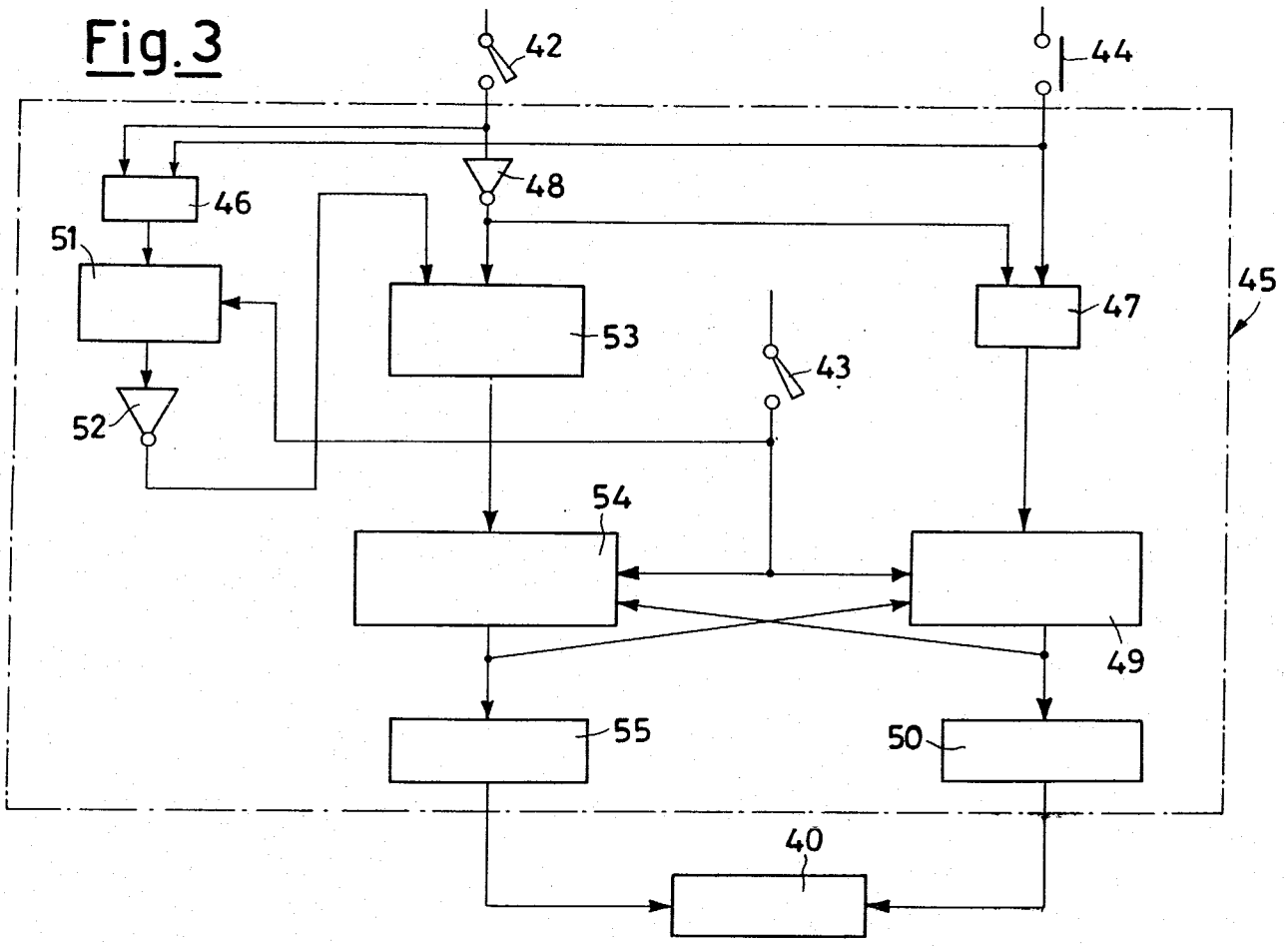

FIG. 2 diagrammatically shows in plan view the packaging machine aforementioned, and FIG. 3 is a block diagram of an exemplary device according to the invention.

FIGS. 1 and 2 diagrammatically show a packaging machine of conventional make, which feeds, one at a time, the articles, 1, to be packaged, to a wrapping station, 2, wherein the articles are wrapped by individual film sections 3, to be subsequently severed from each other by a cutting blade 4 which welds them and coacts with a counterblade 5.

As shown in FIG. 2, the articles 1 comprise a section, 6, for example an addressing label, which is intended to take an accurately defined position relative to a corresponding section 7 (for example a transparent window) which is present in each of the film sections 3. It is thus required that the feed of the articles 1 is in exact phasing relationship with that of the film 3.

The articles 1 are drawn from a hopper 29, wherein they are superposedly stacked, by means of two couples of motor-driven rollers 21 and a plate 8 reciprocated horizontally by a lever 9 pivoted at 10 and driven by a rod 11. The latter, in turn, is driven by a wheel 12 arranged eccentrically on a pivotal pin 13: a pinion 14 is axially mounted on 13. A driving chain 15 connects pinion 14 to another pinion 16: the latter, via a bevel gear 17 receives the drive from a drive-transfer shaft 18 which, in its turn is rotated by a motor 19 through a chain drive-transfer 20. The drive-transfer shaft 18 also delivers, via a bevel gear 22 and a chain drive 23, the command for the drive of a conveyor 24: this has pushing dogs 25 evenly spaced apart along a belt 26 and the pushing dogs thus are fed one after the other at regular intervals and fed, on a plane 27 fitted with a longitudinal slot 28 (FIG. 2) the articles, 1, as they are drawn from the hopper 29.

The film 3, in its turn, is paid off of a bobbin 30 up to a conveyor belt 31, so as to receive thereon, in correspondence with the sequential film sections, the several article to be wrapped. By the agency of properly shaped guiding means, which are conventional and thus are not shown in the drawings hereof, the film 3 is folded around and above the articles 1, whereafter it is welded and, in addition, subjected to a double welded seam between an article and its next and to a cut therebetween by the action of the blade 4 and counterblade 5. While 5 is fixed in space, blade 4 has a reciprocation relative to the counterblade 5, by exploiting a conventional actuator the details of which are disclosed, inter alia, in the U.S. Pat. No. 3,758,366. The blade 4 receives the drive via a rod 32 and a crank 33: the latter is driven to rotation by the drive-transfer shaft 18 via a bevel gear 34, a chain drive 35, and a gearing 36. The bevel gear 34 drives also the conveyor belt 31, via two chain drives 37 and 38 and an adjustable output speed differential 39 equipped with a control motor 40.

Driving motor 40, and thus the speed permitted to the conveyor belt 31 by the differential 39, is controlled by the device of FIG. 3, which, in its turn, is connected to two microswitches 42 and 43 associated to a cam 41 integral with the drive-transfer shaft 18 (and is thus in correct phase with the feed of the articles 1) and with a photoelectric cell system 44 arranged along the route of the film 3 from the bobbin 30 to the conveyor belt 31 for detecting the run of the reference symbols 7 on the film. The position of the photoelectric cell 44 is so selected as to signal the run of the reference symbols 7 concurrently with the actuation of the microswitch 42 if, and only if, the film 3 is correctly positioned relative to the articles 1.

As shown in FIG. 3, the signals delivered by the microswitch 42 and by the photoelectric cell 44 synchronously with the feed of the articles 1 and the film 3, respectively, are processed by a comparison circuitry 45, which is comprised of two logical and gates, 46 and 47, the first with inputs directly associated with the photoelectric cell 44 and the microswitch 42, and the second with either input directly associated with the photoelectric cell 44 and the other input associated with the microswitch 42 via an inverter 48. At the output of the AND gate 47 there is arranged a storage 49 which, via a timer 50, can apply to the motor 40 of the differential 39 a command for reducing the speed. At the output of the AND gate 46, conversely, a storage 51 is arranged, which via an inverter 52, can apply a cutoff command to a monostable multivibrator 53: this is driven by the microswitch 42 via inverter 48. The monostable 53 drives, in its turn, whenever it is enabled, a storage 54, which, via a timer 55, is capable of applying a speed increase command to the motor 40 of the differential 39. The microswitch 43 has the task of providing to clearing the storages 49 and 54, each of which is also capable of providing to clear the other storage concurrently with the command of the attendant timer 50, 55.

The result is the following mode of operation of the control device of FIG. 3. If the photoelectric cell 44 signals the pass of a reference symbol 7 of the film 3 (more detailedly, if in the case considered in FIG. 2 the rear edge of the window 7) while the microswitch 42 is closed by the cam 41 and this fact indicates that the film 3 is correctly phased relative to the articles 1, the AND gate 47 does not deliver any output to the storage 49, whereas the AND gate 46 delivers an output for the storage 51: the latter, via the inverter 48 cuts off the monostable multivibrator 53. Thus, not even the storage 54 receives signals adapted to cause the motor 40 of the differential 39 to enter action, so that the conveyor belt 32 proceeds with its speed unaltered and the film 3 can thus maintain the correct phasing relationship with the articles 1. If, conversely, the photoelectric cell 44 signals the pass of a reference symbol 7 on the film 3 prior to the closing of the microswitch 42, and this fact indicates that the film is in advance relative to the articles 1, at the output of an AND gate 47 a signal is generated which, stored in the storage 49 causes, via the timer 50, the energization of the motor 40 in the sense of reducing the speed of the conveyor belt 31 and consequently of the film 3. If, lastly, the photoelectric cell 44 signals the pass of a reference symbol 7 on the film 3 after that the closure period of the microswitch 42 is over, and this fact indicates that the film 3 is delayed relative to the articles, 1, none of the AND gates 46 and 47 delivers output signals and, conversely, the monostable multivibrator 53 is energized by the inverted signal of the microswitch 42 and produces via the storage 54 and the timer 55 the actuation of the motor 40 in the sense of increasing the speed of the conveyor belt 31 and thus that of the film 3. Every possible discrepancy of the film position from the correct phasing relationship with the articles 1 is thus automatically taken up.

We claim:

1. A device for correctly positioning film web relative to articles to be wrapped thereby in a packaging machine which employs a printed film web whereon the articles are sequentially fed to be subsequently wrapped in wrappers by means for folding down the film web and for welding and cutting sequential sections of said film web, said device comprising: first means for detecting the position of the articles prior to their engagement by the printed film web; second means for detecting the position of the printed symbols reported on sequential film web sections prior to the engagement of said section with the respective articles to be wrapped; means for comparison of the indication of said first and second detecting means, said comparison means including a first logical gate for detecting coincident indications coming from said first and said second detection means, a second logical gate for detecting advanced indications from said second detecting means relative to those coming from said first detecting means and a monostable multivibrator responsive to every indication from said first detection means but which can be disabled by said first logical gate whenever coincident indications are detected coming from both said first and said second detection means; and actuating means controlled by said comparison means to vary the feeding speed of the film web relative to the speed at which said articles are forwarded in the case in which the indications of said first detecting means do not coincide with those of said second detecting means, said actuating means including a variable output speed differential inserted in the film web feeding system, and said second logical gate and said stable multivibrator being associated with said actuating means so as to command the decrease and increase, respectively, of the film web speed.

2. A device as in claim 1 wherein said first detecting means includes a microswitch coacting with a cam rotated synchronously with the feed of the articles towards their being engaged with the printed film web.

3. A device as in claim 1 wherein said second detection means includes a photoelectric cell system inserted in the feed route of the film web in such a position that the coincidence of the indication of both said first and said second detecting means is indicative of the correct positioning of said film web relative to said articles.

* * * * *